US005116245A

United States Patent [19]

Baker

[11] Patent Number: 5,116,245

[45] Date of Patent: May 26, 1992

[54] COAXIAL ELECTRICAL CONNECTORS AND THEIR MANUFACTURE

[75] Inventor: Robert W. Baker, Kenton, England

[73] Assignee: AMP Incorporated, Harrisburg, Pa.

[21] Appl. No.: 752,713

[22] Filed: Aug. 30, 1991

[30] Foreign Application Priority Data

Sep. 7, 1990 [GB] United Kingdom ..... 9019540

[51] Int. Cl.[5] ..... H01R 17/04

[52] U.S. Cl. ..... 439/581; 439/582; 439/63; 29/884

[58] Field of Search ..... 29/876, 884; 439/578–585, 675, 906, 885, 650–655

[56] References Cited

U.S. PATENT DOCUMENTS

| | | | |
|---|---|---|---|
| 2,952,823 | 9/1960 | Robinson | 439/582 |
| 4,611,878 | 9/1986 | Hall et al. | 439/610 |
| 4,687,446 | 8/1987 | Birch et al. | 439/581 |
| 4,759,722 | 7/1988 | Song | 439/578 |
| 5,062,809 | 11/1991 | Sakamoto et al. | 439/581 |

*Primary Examiner*—David L. Pirlot

*Attorney, Agent, or Firm*—William B. Noll

[57] ABSTRACT

A coaxial electrical connector (2) comprises a pair of half shells (4 and 6) each having a shield forming part (12) which is semi-circular in cross section and defines a swept rectangle. The half shells (4 and 6) are assembled to a dielectric insert (8) having an axial slot (34) receiving a center pin (10), so that the shield forming portions (12) of the half shells enclose the insert (8). Tabs (26) and (28) on one half shell (4) are bent down into notches (30 and 32) in the other half shell (6) to secure the half shells (4 and 6) about the insert (8). Each half shell is connected in side by side relationship with a plurality of identical half shells by means of a carrier strip (42) for conveying the half shells to an assembly station AS. One or both of the carrier strips (42) is allowed to remain connected to its respective half shells until a desired multiplicity of the connectors (2) have been assembled. The strip of connectors (2) so provided, is wound about a storage reel for mounting on a stitching machine for severing the connectors (2) from the carrier strip or carrier strips (42) and loading the connectors (2) into insulating housings.

13 Claims, 4 Drawing Sheets

COAXIAL ELECTRICAL CONNECTORS AND THEIR MANUFACTURE

This invention relates to coaxial, shielded electrical connectors and to a method of manufacturing such connectors for application to an insulating housing by means of a stitching machine.

SUMMARY OF THE INVENTION

According to one aspect of the invention, a method of manufacturing coaxial shielded, electrical connectors, comprises the steps of;

a. providing first and second strips of metal half shells, the half shells of each strip being connected together by means of carrier strips, each half shell of one of said first and second strips being mateable with each half shell of the other of these strips to define a tubular shield;

b. feeding each strip of half shells towards an assembly station to locate a half shell of each strip thereat, with the half shells so located, being relatively positioned for mating, but in spaced relationship;

c. providing between the half shells so located, a dielectric insert with a centre pin extending coaxially therethrough;

d. mating the half shells so located, about said insert, thereby to enclose said insert in the tubular shield defined by the mated half shells;

e. securing said mated half shells together so that said insert is snuggly received in said tubular shield with the centre pin coaxial therewith;

f. repeating steps (b) to (e) a multiplicity of times; and g. winding the strip of shielded, coaxial electrical connectors so produced, about a storage reel.

For inserting the connectors in a housing, the storage reel is mounted to a conventional stitching machine.

As will be appreciated, the entire assembly of the connectors is completed with the half shells connected together in strip form, by a method which is readily susceptible to automation.

In step (e), the centre pin may be inserted, at the assembly station, into an axial slot provided in the dielectric insert or, the insert may be supplied to the assembly station with the centre pin in place therein.

Immediately following step (e), one of the mated half shells at the assembly station, may be severed from its carrier strip.

The mated half shells may be secured together by bending at least one flange on one of the half shells over an edge of the other.

The invention further concerns, a shielded coaxial electrical connector which is susceptible to manufacture by means of the method according to the present invention. According to another aspect of the invention, therefore, a coaxial, shielded electrical connector comprises a pair of metal half shells each defining an open ended, arcuate cross section, shield forming part, these shield forming parts being of equal radius and each shield forming part being formed integrally with a base plate and having first and second free ends; fastening means securing the base plates together in contiguous relationship with the said shield forming parts in both axial and radial alignment to define a tubular shield; a dielectric insert snugly received in the tubular shield, an end of the insert terminating back from said first free ends of the shield forming parts; the insert having formed therein an axial opening opening into both ends thereof; and a centre pin snugly received in said slot in coaxial relationship with said tubular shield, one end of the centre pin projecting from one end of the insert and the other end of the pin extending from the other end of said insert.

In the manufacture of a connector as defined above, the carrier strips are connected to the base plates of the half shells by means of metal slugs which can be sheared out by means of the stitching machine.

The invention concerns, in particular, a shielded, coaxial right angle electrical connector which can conveniently be produced by a method according to the invention.

According to a further aspect of the invention, a shielded coaxial right angle electrical connector comprises a pair of metal half shells each defining an open ended, semi-circular section, shield forming part formed integrally with a base plate, each shield forming part consisting of a rectilinear first portion merging with an arcuate second portion defining a swept right angle, each of said portions having a free end; fastening means securing said base plates together in contiguous relationship with said shield forming parts in both axial and radial alignment to define a tubular shield; a dielectric insert snugly received in said shield, one end thereof terminating back from the free ends of said first portions of said shield forming parts, and the insert extending around said swept right angle, the insert having formed therein an axial slot opening into both ends thereof; and a centre pin snugly received in said slot in coaxial relationship with said tubular shield, one end of the centre pin projecting from said one end of the dielectric insert and the other end of the pin extending from the other end of said insert at right angles to said one end of the pin.

By virtue of the swept rectangular shape of the coaxial parts of the connector, the gap between the inner conductor, namely the centre pin, and the inner diameter of the shield is constant throughout the length of the coaxial parts, whereby the impedance thereof is also constant throughout their length so that the connector is suitable for use with very high frequencies.

The base plate is preferably formed with a pair of parallel mounting lugs projecting from opposite sides of the free ends of said second portions of the shield forming parts, in parallel relationship with said other end of the centre pin, each lug of each base plate being aligned with a lug of the other base plate in superposed, and at least closely proximate relationship therewith. When the connector has been inserted into its housing, with the mounting lugs and said other end of the centre pin projecting beneath the housing, the lugs and the said other end, can be inserted through respective holes in a printed circuit board for soldering to a ground conductor and a signal conductor of the board, respectively. By virtue of the soldering operation, each of said pairs of mounting lugs is securely electrically connected, thereby securely electrically connecting the two half shells of the connector.

DETAILED DESCRIPTION OF PREFERRED EMBODIMENTS

Figure 1:
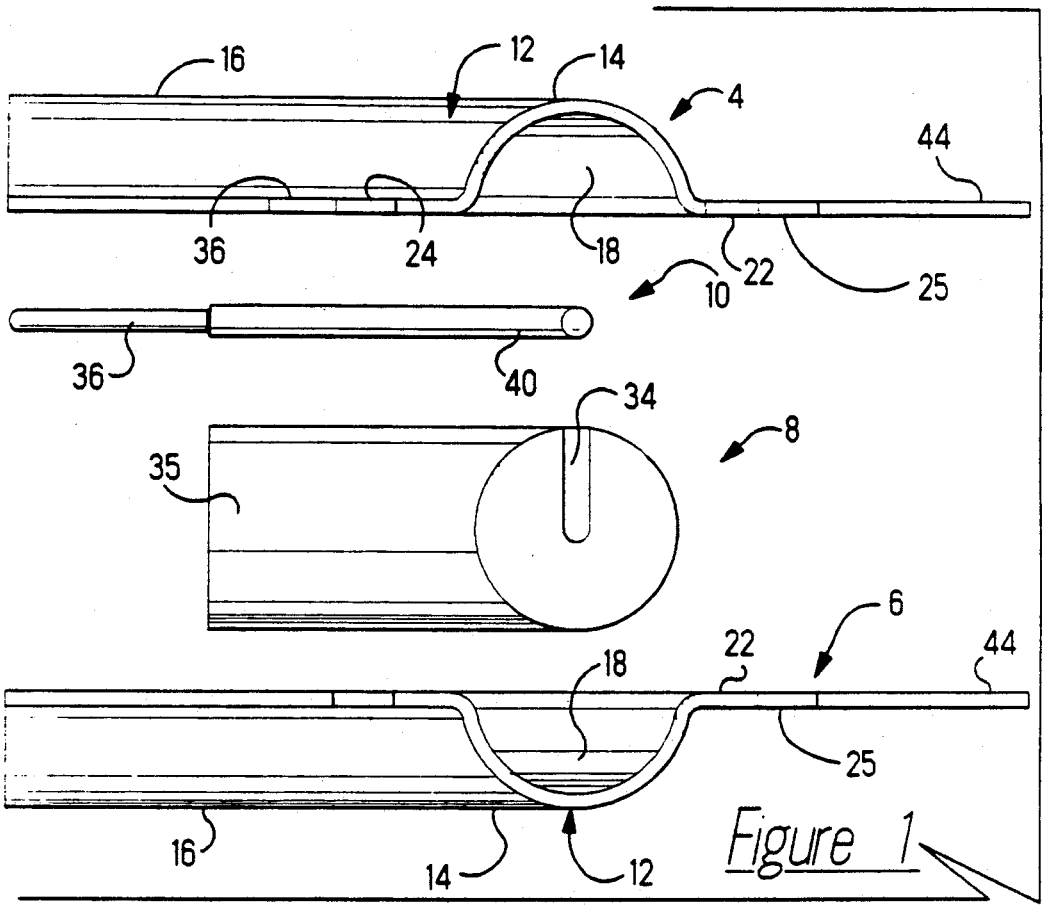
FIG. 1 is an exploded side view of a shielded, coaxial, right angle electrical connector.
Figure 2:
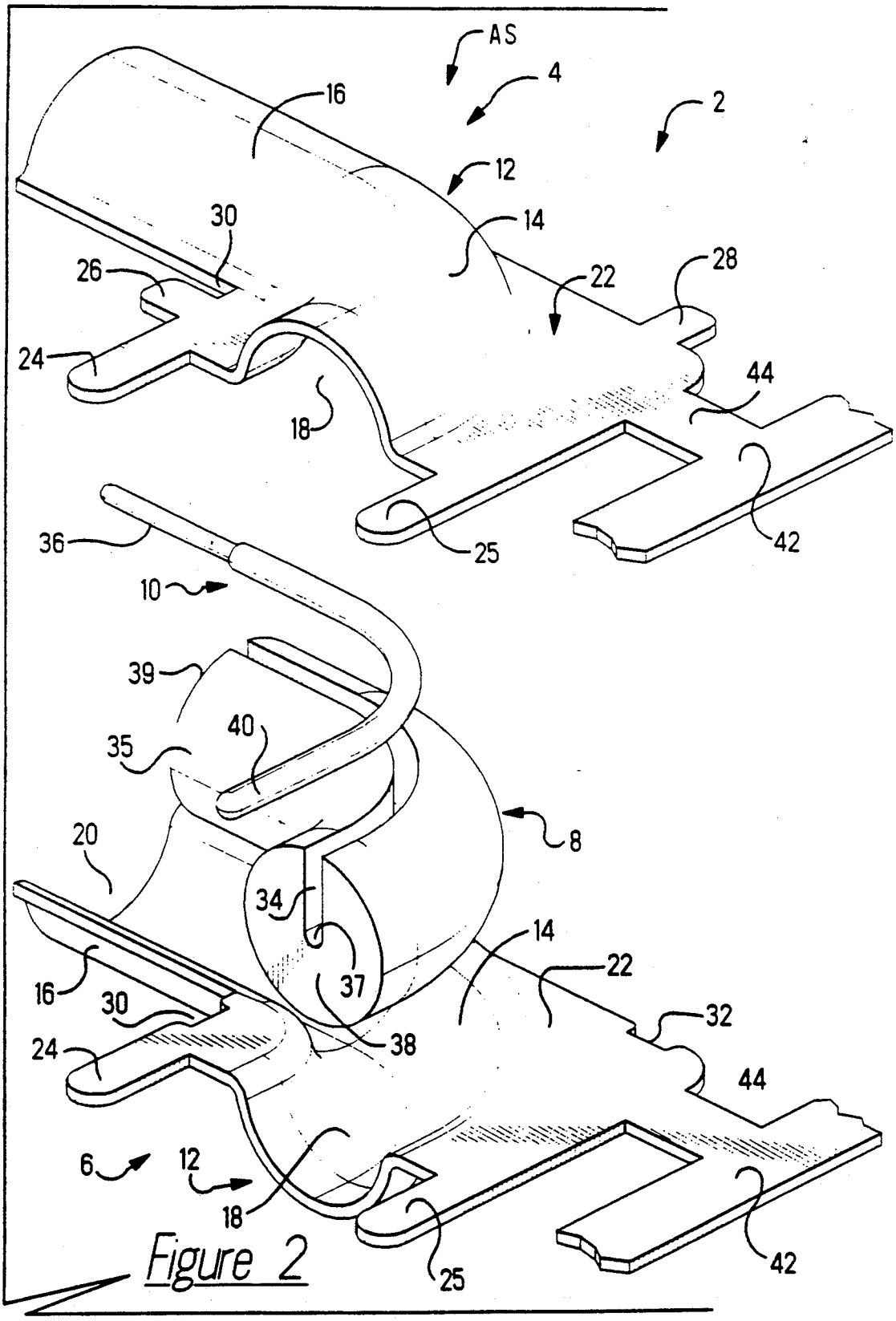
FIG. 2 is an exploded isometric view of the connector, illustrating its manner of manufacture.
Figure 4:
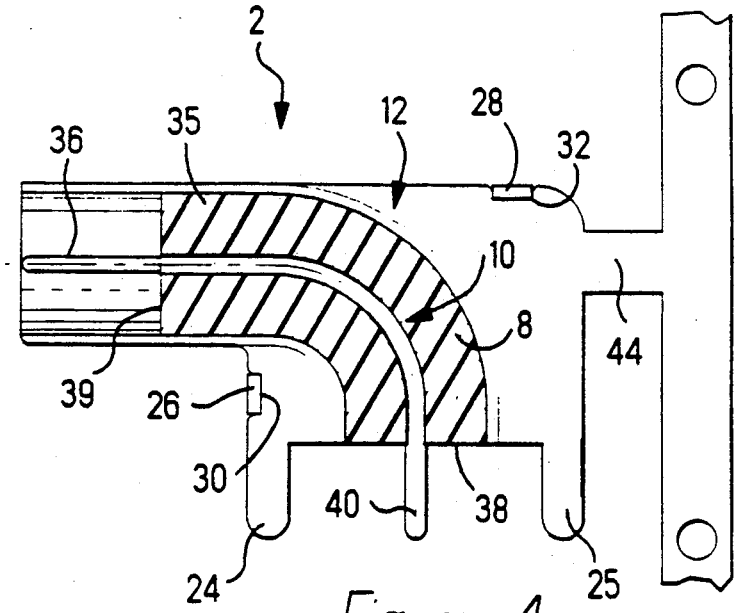
FIG. 4 is an axial sectional view of the connector.
Figure 5:
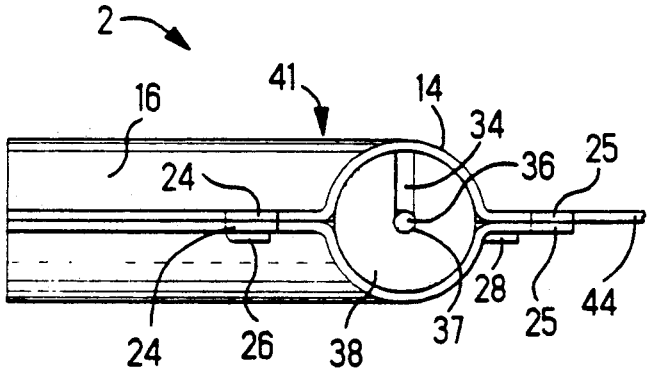
FIG. 5 is an end view of the connector.

As best seen in FIGS. 1 and 2, a shielded, right angle coaxial pin connector 2, for mounting on a printed circuit board, comprises two metal half shells, 4 and 6, respectively, a dielectric insert 8, and a centre pin 10.

Each half shell 4 and 6, which has been stamped and formed as part of a strip of half shells, from a single length of sheet metal stock by means of a progressive stamping and forming operation, comprises a shield forming part 12 and a base plate 22. The shield forming part 12 is of semi-circular cross section, is continuous, and is of constant radius. The part 12 consists of a rectilinear first portion 16 merging with a smoothly arcuate second portion 14 describing a swept right angle as seen in plan view. The part 12 has first and second open ends 18 and 20, respectively, opening in directions at right angles with respect to one another. The longitudinal edges of the portion 14 of each half shell 4 and 6 are formed integrally with the base plate 22 which is coplanar and extends away from the portion 14 in the plane of the axis of curvature of the cross section of the shield forming part 12. There extend from each plate 22, in the plane thereof, two rectilinear, parallel, mounting lugs 24 and 25, respectively, on either side of the open end 18 of the portion 14, the lugs 24 and 25 projecting there beyond. The base plate 22 of the half shell 4 is formed with two fastening tabs 26 and 28, respectively, the tab 26 projecting from the plate 22 at right angles to the lug 24 and being proximate thereto. The tab 26 lies alongside the portion 16 of the shield forming part 12. The tab 28 projects from the plate 22 on the opposite side thereof to the lug 25. The half shell 6 differs from the half shell 4 in that instead of having the tabs 26 and 28 it is provided with tab receiving notches 30 and 32, respectively, positioned for receiving the tabs 26 and 28, respectively.

The dielectric insert 8 is of the same configuration as the shield forming part 12, excepting in that the rectilinear part 35 of the insert 8, is shorter than the rectilinear portion 16 of the shield forming part 12. The insert 8, which is of circular cross section of substantially the same radius as that of the cross section of the part 12, is formed with a through central axial slot 34 having a semi-circular cross section base 37 which is coaxial with the outer periphery of the insert 8. The slot 34 is dimensioned to receive the centre pin 10, which is also of circular cross section, for snug reception in the arcuate base 37 of the slot 34, with a mating pin terminal 36 projecting from the end 39 of the rectilinear portion 35 the insert 8, and a rectilinear connecting pin 40 projecting from the opposite end 38 of the insert 8.

Each half shell 4 and 6 is connected to a respective carrier strip 42 to which a multiplicity of identical half shells are connected by way of metal slugs 44. The half shells of each strip thereof are thereby connected in side by side relationship.

Figure 3:
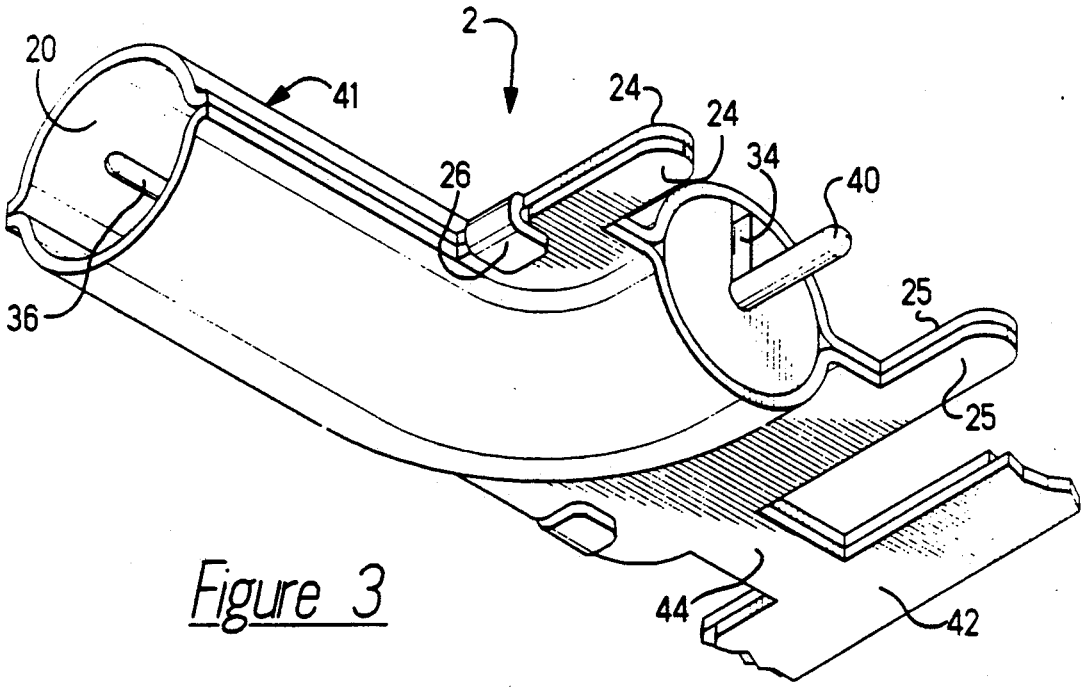
FIG. 3 is an isometric view of the connector.
Figure 6:
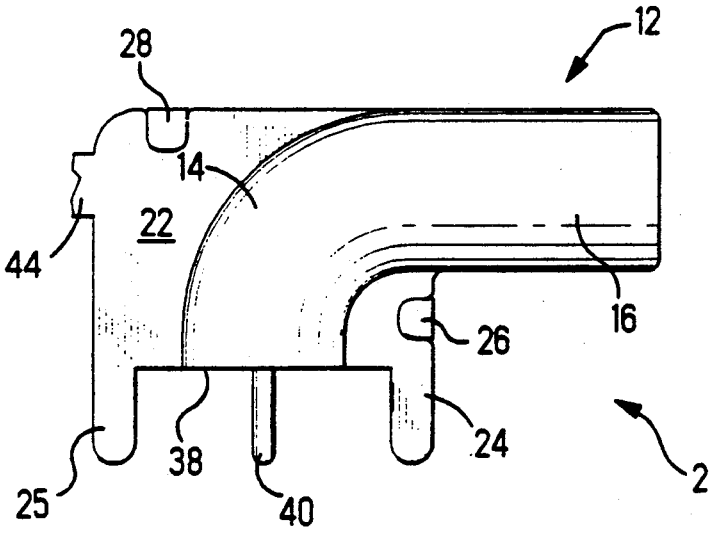
FIG. 6 is a side view of the connector.

In order to provide a continuous strip of connectors 2, each connector 2 is assembled by advancing the two carrier strips 42 to an assembly stations AS in a superposed, spaced, reversed, relationship as shown in FIG. 2, the pair of half shells 4 and 6 being thereby positioned to be mated to one another as described below. At the assembly station AS, the dielectric insert 8 is dropped into the shield forming part of 12 the lower most half shell, namely the half shell 6, and the centre pin 10 is dropped into the channel 34 of the insert 8 with the pin terminal 36 projecting from the end 39 thereof and the connecting pin 40 projecting from the end 38 thereof. The half shells 4 and 6 at the assembly station then brought together in mating relationship so that the insert 8 is snugly received in a circular cross section, tubular shield 41 which is now defined by the shield forming portions 12 of the two half shells 4 and 6 in the mated position of the half shells 4 and 6. Each mounting lug 24 and 25 of one of the half shells is aligned with, and lies flat against the respective corresponding mounting lug of the other half shell as best seen in FIG. 3, the tab 28 of the half shell 4 being aligned with the notch 32 of the half shell 6 and the tab 26 of the half shell 4 being aligned with the notch 30 of the half shell 6. In order to secure the half shells 4 and 6 firmly together in mating relationship, the tabs 26 and 28 are bent down into the notches 30 and 32, respectively, to engage the base plate 22 of the half shell 6, as best seen in FIGS. 3 and 6. One of the slugs 44 connecting one of the half shells to its carrier strip may now be severed, leaving the completed connector 2 connected to the remaining half shells by means of the other carrier strip.

The carrier strips 42 are advanced step by step through the assembly station AS until a desired multiplicity of the pairs of shell halves 4 and 6 on the carrier strips, have been assembled in the manner described above.

Figure 7:
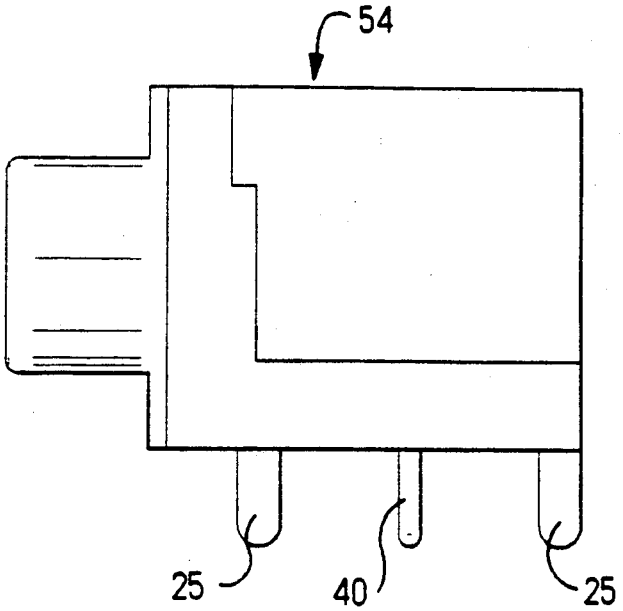
FIG. 7 is a side view of the connector when it has been assembled to an insulating housing.
Figure 8:
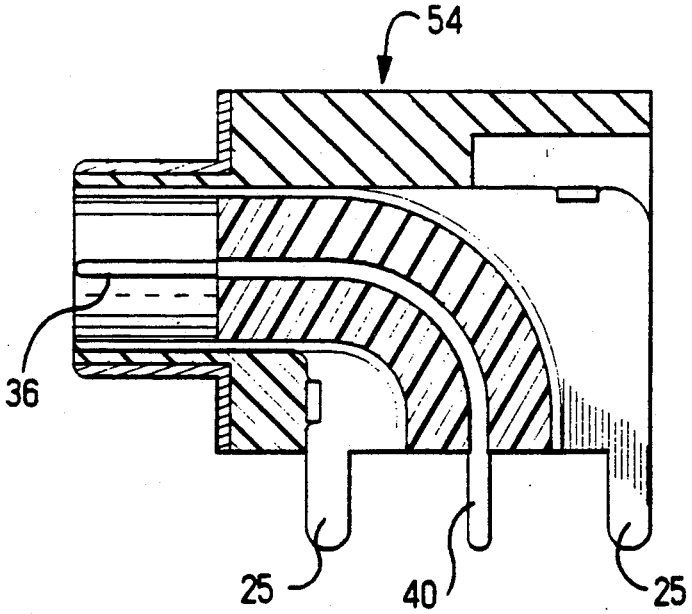
FIG. 8 is an axial sectional view of the assembly shown in FIG. 7.

The strip of connectors 2 so provided, is then wound on to a storage reel (not shown) and the reel is mounted to a stitching machine (not shown) for severing the connectors 2 from the remaining carrier strip and for assembling them to insulating housings 54 (FIGS. 7 and 8). When each connector 2 has been assembled to its housing 54, each pair of contiguous mounting lugs 24 and each pair of contiguous mounting lugs 25, as well as the connecting pin 40 project below the housing 54 for insertion in corresponding holes in a printed circuit board (not shown) to be soldered to a grounding conductor and a signal conductor, respectively, thereon. By virtue of the soldering operation, the lugs of each pair of contiguous mounting lugs, are firmly soldered together so that secure electrical connection is made between the half shells 4 and 6.

Before the assembly of the connectors 2, the strips of half shells may be processed in respective plating baths for selectively plating with gold, the interiors of the end parts of the portions 16 of the shield forming parts 12 and for selectively tin plating the mounting lugs 24 and 25.

Instead of the centre pins 10 being assembled to the inserts 8 at the assembly station, they may be preassembled thereto.

In the case of each assembled connector 2, the tubular shield 41 snugly receives the dielectric insert 8, which is coaxial therewith.

By virtue of the swept right angle shape of the coaxial parts of the connector 2, the gap between the inner conductor, namely the centre pin 10, the inner diameter of the shield 41 is constant throughout the length of said coaxial parts, whereby the impedance thereof is also constant throughout their length so that the connector is suitable for use with very high frequencies.

I claim:

1. A method of manufacturing shielded, coaxial electrical connectors, comprising the steps of;

a. providing first and second strips of metal half shells, the half shells of each strip being connected together by means of carrier strips, each half shell of one of said first and second strips, being mateable with each half shell of the other of these strips to define a tubular shield;

b. feeding each strip of half shells towards an assembly station to locate a shell half of each strip thereat with the shell halves so located being relatively positioned for mating, but in spaced relationship;

c. providing between the half shells so located, a dielectric insert with a centre pin extending coaxially therethrough;

d. mating said half shells so located insert, thereby to enclose said insert in the tubular shield defined by the mated half shells;

e. securing said mated half shells together so that said insert is snugly received in said tubular shield coaxially therewith;

f. repeating steps b to e a multiplicity of times; and g. winding the strip of shielded coaxial electrical connectors so produced about a storage reel.

2. The method as claimed in claim 1, wherein during step (e) the centre pin is inserted into an axial slot in the dielectric insert.

3. The method as claimed in claim 1, wherein between steps (e) and (f) one of said mated half shells is severed from its carrier strip.

4. A method as claimed in claim 1 wherein step (e) comprises the step of bending at least one fastening tab on one of the half shells over an edge of the other half shell.

5. A shielded, coaxial electrical connector comprising a pair of metal half shells each defining an open ended, arcuate cross section, shield forming part, these shield forming parts being of equal radius and each shield forming part being formed integrally with a base plate and each having a first and second free end; fastening means securing the base plates together in contiguous relationship, with said shield parts in both axial and radial alignment to define a tubular shield; a dielectric insert snugly received in the tubular shield, one end of the insert terminating back from said first free end of the shield forming parts, the insert having formed therein, an axial slot opening into both ends thereof; and a centre pin snugly received in said slot in coaxial relationship with said tubular shield, one end of the centre pin projecting from one end of said insert and the other end of the pin extending from the other end of said insert.

6. The connector as claimed in claim 5, wherein said tubular shield, said dielectric insert and said centre pin each define a swept right angle.

7. The connector as claimed in claim 5, wherein said base plates co-operate to define a two part mounting lug for insertion into a hole in a printed circuit board.

8. The connector as claimed in claim 5, wherein said fastening means comprises at least one flange on one of the base plates which has been bent over the other base plate.

9. A shielded, coaxial right angle electrical connector comprising a pair of metal half shell each defining an open ended, semi-circular cross section, shield forming part formed integrally with a base plate, each shield forming part consisting of a rectilinear first portion merging with an arcuate second portion defining a swept right angle, each of said portions having a free end; fastening means securing said base plates together in contiguous relationship, with said shield forming parts in both axial and radial alignment to define a tubular shield; a dielectric insert snugly received in said shield, one end thereof terminating back from the free ends of the first portions of said shield forming parts and the insert extending about said swept rectangle, the insert having formed therein an axial slot opening into both ends thereof; and a centre pin snugly received in said axial slot in coaxial relationship with said tubular shield, one end of the centre pin projecting from said one end of the dielectric insert and the other end of the pin extending from the other end of said insert at right angles to said one end of the pin.

10. The connector as claimed in claim 9, wherein each base plate is formed with a mounting lug projecting therefrom beyond the free ends of said second portion of the shield forming parts, said mounting lugs being aligned with each other in superposed, and at least closely proximate, relationship.

11. The connector as claimed in claim 9, wherein each base plate is formed with a pair of parallel mounting lugs projecting from opposite sides of the free ends of said second portions of the shield forming parts in parallel relationship with said other end of the centre pin, each lug of each base plate being aligned with a lug of the other base plate, in superposed, and at least closely proximate, relationship therewith.

12. The connector as claimed in claim 9, wherein each base plate is coplanar, the free ends of the plates being provided with co-operating tabs and notches constituting said fastening means.

13. The connector as claimed in claim 9, wherein said opening in the insert is an axial slot opening into both ends of the insert and having an arcuately concave base.

* * * * *